United States Patent [19]

Koiwa

[11] Patent Number: 5,035,229

[45] Date of Patent: Jul. 30, 1991

[54] IGNITION DEVICE FOR AN INTERNAL COMBUSTION ENGINE

[75] Inventor: Mitsuru Koiwa, Himeji, Japan

[73] Assignee: Mitsubishi Denki Kabushiki Kaisha, Tokyo, Japan

[21] Appl. No.: 533,320

[22] Filed: Jun. 5, 1990

[30] Foreign Application Priority Data

Jun. 7, 1989 [JP] Japan ..... 1-142927
Jun. 7, 1989 [JP] Japan ..... 1-142929

[51] Int. Cl.[5] ..... F02P 7/077
[52] U.S. Cl. ..... 123/626; 123/179 BG
[58] Field of Search ..... 123/609, 618, 625, 179 BG, 123/626

[56] References Cited

U.S. PATENT DOCUMENTS 4,051,827 10/1977 Capurka et al. ..... 123/645
4,167,927 9/1979 Mikami et al. ..... 123/609
4,202,304 5/1980 Jundt et al. ..... 123/618
4,356,808 11/1982 Bodig et al. ..... 123/609

*Primary Examiner*—Andrew M. Dolinar

*Attorney, Agent, or Firm*—Sughrue, Mion, Zinn, Macpeak and Seas

[57] ABSTRACT

An engine ignition device comprises a circuit which generates a bias voltage corresponding to the engine rpm and superimposes it on an ignition signal so that the closing rate of the primary power feeding circuit for an ignition coil is controlled, a switching operation level setting circuit for generating a set voltage which changes with the engine rpm at startup or idling, and a comparison circuit having a first input receiving the ignition signal and superposed bias voltage and a second input receiving the set voltage, and generating an inverted output. The magnitude of the set voltage is changed in response to the engine rpm between the starting time and the idling time such that when the engine is started, the potential difference between voltages at the input terminals of the comparison circuit, as determined by the bias and set voltages, assumes a first value smaller than the ignition signal voltage, and when the engine is idling, the potential difference assumes a second value smaller than the ignition signal voltage, but larger than the first value.

1 Claim, 5 Drawing Sheets

IGNITION DEVICE FOR AN INTERNAL COMBUSTION ENGINE

BACKGROUND OF THE INVENTION

1. Field of the Invention

The present invention relates to an improvement of an ignition device for an internal combustion engine.

2. Discussion of Background

FIG. 4 is a circuit diagram showing a conventional ignition device for an internal combustion engine disclosed in, for instance, Japanese Examined Patent Publication No. 54508/1985. In FIG. 4, a reference numeral 1 designates an ignition signal generating device for generating an ignition signal in response to the revolution of an engine (not shown), a numeral 2 designates a waveform shaping circuit constituted by input resistors 2*a*, 2*c*, a comparison circuit 2*b*, a transistor 2*e* actuated by the output of the comparison circuit 2*b* and resistors 2*d*, 2*f* connected respectively to the collector and the base of the transistor 2*e* wherein the resistor 2*d* determines histeresis characteristic, a numeral 3 designates a driving circuit for driving a power transistor circuit 4 in response to an output signal from the comparison circuit 2, a numeral 5 designates an ignition coil supplied with a current from a d.c. power source 7, a numeral 6 designates an ignition plug fired by a high voltage produced at the secondary side of the ignition coil 5, a numeral 8 designates a current detecting resistor having a terminal connected in series to the emitter of the power transistor 4 and another terminal which is grounded, a numeral 9 designates a level detecting device which produces an output when the output of the current detecting resistor 8 reaches a predetermined level and which has an input terminal connected to one end of the resistor 8 which has another end connected to the base of a transistor 10*d* through a resistor 10*e* for a bias circuit 10. The bias circuit 10 is adapted to bias (superimpose) a d.c. voltage corresponding to the magnitude of the ignition signal of the ignition signal generating device 1 on the ignition signal. The bias circuit 10 is composed of structural elements 10*a*–10*l*. The capacitor 10*g* is charged through the resistor 10*a* and the diode 10*b* by the above-mentioned ignition signal whereby a d.c. voltage having a magnitude corresponding to the ignition signal voltage is produced. The d.c. voltage is superimposed on the ignition signal.

The transistor 10*i* is connected to the ignition signal generating device 1 through the resistor 10*k* so that a d.c. voltage in the capacitor 10*g* which is charged by the ignition signal of the ignition signal generating device 1 through the resistor 10*a* and the diode 10*b* is received, and a bias voltage corresponding to the d.c. voltage is superimposed on the ignition signal.

The transistor 10*d* receives an output from the level detecting device 9 through the resistor 10*e* so that the charging of the capacitor 10*g* to be charged through the Zener diode 10*c* is controlled.

A numeral 11 designates an initial bias setting circuit for superimposing an initial bias voltage on the ignition signal, which is composed of a serial connection of resistors 11*a*, 11*b*, voltage regulator diodes 11*e*, 11*f* and a transistor 11*c* which provides a regulated voltage by the voltage regulator diodes 11*e*, 11*f* to an emitter follower resistor 11*d*.

A reference numeral 12 designates a switching level setting circuit which determines a level of switching operation for the waveform shaping circuit 2 by applying a voltage output corresponding to the number of revolution of the engine to a negative input terminal of the waveform shaping circuit 2. In the switching level setting circuit 12, a numeral 12*a* designates a transistor to apply a voltage divided by the voltage-dividing resistors 11*a*, 11*b* to an emitter follower resistor 12*c*, a numeral 12*b* designates a transistor to apply a voltage divided by voltage-dividing resistors 12*d*, 12*e*, 12*f* to the emitter follower resistor 12*c*, a numeral 12*g* designates a transistor to receive the voltage of the capacitor 10*g* by its base to thereby generate a voltage corresponding to the voltage of the capacitor 10*g* at emitter follower voltage dividing resistors 12*h*, 12*i*, and a numeral 12*j* designates a transistor which determines a voltage at the junction A between voltage dividing resistors 12*e*, 12*f* on the basis of a voltage divided by the voltage dividing resistors 12*h*, 12*i*.

A numeral 19 designates a transistor actuated by the output of the comparison circuit 2*b*, which functions to switch a level of a signal supplied from the switching operation level setting circuit 12 to the comparison circuit 2*b*. The transistor 19 has the emitter grounded, the base connected to the output side of the comparison circuit 2*b* through a resistor 21, and the collector connected to the junction between the base of the transistor 12*b* and a resistor 20. The another terminal of the resistor 20 is connected to a junction C.

FIG. 5 is a circuit diagram showing a conventional ignition device for an internal combustion engine disclosed, for instance, in Japanese Examined Utility Model Publication No. 24694/1986. In FIG. 5, numerals 1 through 7 designate the same elements as in FIG. 4, and accordingly description of these elements is omitted.

A reference numeral 13 designates a reference voltage generating device which is constituted by a resistor 13*a* connected to the power source 7, a voltage regulator element 13*d* such as a Zener diode connected in series to the resistor 13*a* and voltage dividing resistors 13*b*, 13*c* which determine the voltage of the voltage regulator element 13*d* to a given voltage. A diode 14 has the anode connected to the junction between resistors 17*f*, 17*g* in a d.c. bias circuit 17 and the cathode connected to the collector of a transistor 15. The base of the transistor 15 is connected to an end of the beforementioned resistor 2*f* and the output side of the comparison circuit 2*b* respectively through a resistor 18.

A transistor 16 has the collector grounded, the emitter connected to the emitter of the transistor 15 and the base connected to the junction between the resistor 13*b* and 13*c*, whereby it detects the output voltage of the reference voltage generating circuit 13. The d.c. bias circuit 17 comprises a serial connection of the resistors 17*f*, 17*g*, 17*h* and a diode 17*i* which is connected to the power source 7, an impedance transducing transistor 17*d* having an emitter resistor 17*e*; an impedance transducing transistor 17*c* having an emitter resistor 17*b* and having the base connected to the junction between the resistor 17*h* and the diode 17*i*, and a resistor 17*a*.

The operation of the conventional ignition device for an internal combustion engine having the circuit as shown in FIG. 4 will be described.

When the engine is not operated at the non-starting time of the engine, a bias voltage is applied to one terminal of the comparison circuit 2*b*. The bias voltage is an initial bias voltage given by the emitter follower resistor 11*b* of the transistor 11*c* whose base receives a regulated voltage regulated by the diodes 11*e*, 11*f* in the initial bias setting circuit 11.

When the crank of the engine is operated to start it, an ignition signal having an a.c. voltage is generated from the ignition signal generating device 1. The ignition signal is superimposed on the initial bias voltage. When the superimposed output signal reaches an input terminal voltage at the other input terminal of the comparison circuit 2*b*, the waveform shaping circuit 2 generates an output. The output turns on the power transistor circuit 4 through the driving circuit 3 to thereby start current supply to the ignition coil 5. The transistor 2*e* is turned on in synchronism with the turning-on of the power transistor 4, whereby a voltage divided by the resistors 2*c*, 2*d* is applied to the other input terminal of the comparison circuit 2*b*. When the voltage of the superimposed output signal becomes lower than the input terminal voltage at the other input terminal of the comparison circuit 2*b*, the power transistor 4 is turned off in the opposite manner as described above, whereby an ignition voltage is produced at the ignition coil 5 to thereby result the ignition of the engine.

On the other hand, the capacitor 10*g* is charged by the ignition signal of the ignition signal generating device 1 through the resistor 10*a* and the diode 10*b* so that a d.c. voltage having the magnitude corresponding to the number of revolution of the engine is generated.

When the crank of the engine is actuated and the number of revolution is rapidly increased from a low cranking revolution number to an idling revolution number, namely, when the voltage at the junction B, which is provided by dividing an emitter voltage at the transistor 12*g* which is determined by a voltage in the capacitor 10*g* which is in proportion to the number of revolution of the engine, by the voltage dividing resistors 12*h*, 12*i*, is increased, a voltage at the junction A between the voltage dividing resistors 12*e*, 12*f* is determined by the voltage at the junction B through the transistor 12*j*. Accordingly, the voltage at the junction C of the base of the transistor 12*b* increases so as to correspond to a voltage rise at the junction A. When there comes a predetermined set voltage in a range of revolution number lower than the idling revolution number, the transistor 12*a* is turned off. Then, due to the increase of the voltage at the junction C, a switching voltage in proportion to the revolution number is determined by the transistor 12*b*. Thus, the operation level VON of the comparison circuit 2*b* is increased as the revolution number of the engine increases.

The operation of the ignition device for an internal combustion engine as shown in FIG. 5 will be described.

An ignition signal is generated from the ignition signal generating device 1 in correspondence to the revolution of the engine. The ignition signal is inputted to an input terminal of the comparison circuit 2*b* through the resistor 2*a*. A signal representing an operation level VON is inputted to another input terminal of the comparison circuit 2*b* from the serial circuit of the resistors 17*f*, 17*g* and 17*h* of the d.c. bias circuit 17 through the transistor 17*d* and the resistor 17*e*. On the other hand, a d.c. bias voltage is applied to the ignition signal generating device 1 through the transistor 17*c* and the resistor 17*a*. When an ignition signal having a magnitude higher than the operation level VON is produced in accordance with the revolution of the engine, the waveform shaping circuit 2 generates a signal, and at the same time, turns on the transistor 2*e* through the resistor 2*f* whereby the operation level VON is changed to an operation level of VOFF which is determined by the resistors 2*c*, 2*d* and 17*e*. When the revolution number of the engine is further increased, the output of the comparison circuit 2*b* is inversed at a point that the ignition signal becomes the operation level VOFF or lower, and at the same time, an ignition voltage is produced at the ignition coil. At this moment, since the power source voltage is applied to the comparison circuit 2*b* through the resistors 17*f*, 17*c* and the transistor 17*d*, the operation level VON changes depending on a change in the power source voltage.

Although the operation level VOFF changes depending on a change in the power source voltage in the same manner as the operation level VON, the voltage of the base of the transistor 16 is substantially constant in a voltage region higher than the power source voltage, which effects the actuation of the voltage regulator element 13*d*. Accordingly, when the ignition signal has a level higher than the operation level VON, the transistor 15 is turned on by the output of the comparison circuit 2*b*, whereby the potential at the junction between the resistors 17*f*, 17*g* viewed from the side of the diode 14 is substantially constant in voltage at a voltage region higher than a predetermined power source voltage in the same manner as the emitter potential, i.e. the base potential at the transistor 16. Accordingly, the potential applied from the junction of the resistors 17*f*, 17*g* through the transistor 17*d* to the comparison circuit 2*b* becomes also constant. Further, while the transistor 15 is turned on by the output of the comparison circuit 2*b*, the transistor 2*e* is turned on, whereby the operation level VOFF having a substantially constant voltage is obtainable by the resistor 2*d* in a voltage region higher than the predetermined power source voltage. Namely, while the operation level VON changes depending on the power source voltage in a voltage range higher than the predetermined power source voltage, the operation level VOFF is constant regardless of the power source voltage, whereby the histeresis becomes large. The operation level VOFF can be changed by selecting the resistance of the resistors 13*b*, 13*c*. When the voltage cf the power source is lower, ignition timing can be delayed at the time of starting by selecting the values of the resistors 13*b*, 13*c*, 17*f*, 17*g* so that the operation level VOFF assumes a negative value to the reference level of the ignition signal generating device 1. In this case, the histeresis becomes large.

Thus, in the above-mentioned conventional ignition devices, it was difficult to increase durability to noises induced in the ignition signal generating device at a range of revolution number of the engine which is higher than that of idling revolution number while excellent starting performance could be maintained.

Further, in the ignition device as shown in particular in FIG. 5, there was a problem that the operation level VOFF changed depending on a change in voltage in the power source even though the d.c. bias voltage of the ignition signal generating device 1 was substantially constant even by the change in the power source voltage because the operation level VOFF was determined by dividing the operation level VON by the resistors 2*c*, 2*d* when the transistor 2*e* was turned on. Further, scattering of the operation level VOFF to the d.c. voltage of the ignition signal generating device 1 was found due to the scattering in the absolute value of the resistors 3*b*, 3*e*, 3*f*, 3*f*, the scattering of the base-emitter voltage of the transistors 3*c*, 3*d*, the scattering of the forward voltage of the diode 3h, the scattering of the saturated voltage between the collector and emitter of the transistor 2e and so on.

In the ignition device as shown in FIG. 5, it was difficult to obtain ignition timing in a stable manner at a d.c. bias point of an ignition signal from the signal generating device because the operation level VOFF was deviated from the bias level of the signal waveform due to the fluctuation of the power source voltage and the scattering of the structural elements. Further, it was difficult to obtain such function that a current was not supplied to an ignition coil when the engine was stopped (hereinafter, referred to as an interrupting function).

SUMMARY OF THE INVENTION

It is an object of the present invention to provide an ignition device for an internal combustion engine capable of increasing durability to noises induced at a revolution number of the engine which is higher than that of an idling revolution number while the starting performance of the engine can be maintained.

It is an object of the present invention to provide an ignition device for an internal combustion engine which provides stable ignition timing at a d.c. bias point of an ignition signal waveform and has an excellent interrupting function.

In accordance with the present invention, there is provided an ignition device for an internal combustion engine which comprises an ignition signal generating device which generates in synchronism with the revolution of an engine an ignition signal having the magnitude corresponding to a revolution number of the engine, a bias circuit which generates a bias voltage corresponding to the revolution number of the engine so as to superimpose the bias voltage on the ignition signal so that the closing rate of the primary power feeding circuit for an ignition coil is controlled, a switching operation level setting circuit for generating a set voltage which changes depending on the revolution number of the engine at the time of the starting of the engine or at the idling operation, a comparison circuit having a first input terminal adapted to receive a superimposed output of the ignition signal and the bias voltage and a second input terminal adapted to receive the set voltage wherein the comparison circuit generates an output inversed in level in response to the magnitude of input signals at the first and second input terminals, a transistor to feed or break a current to be fed to the ignition coil by an output from the comparison circuit, a hysteresis setting circuit to impart hysteresis to the switching operation of the comparison circuit by changing the set voltage inputted to the second input terminal in synchronism with the turning-on of the transistor, a reference voltage generating circuit which fixes the potential of a plurality of resistors in the bias circuit when a power source voltage exceeds a predetermined value, and a transistor circuit which controls current conduction to the plurality of resistors and the reference voltage generating circuit in response to the operation of the comparison circuit, wherein the magnitude of the set voltage is changed in response to a value of revolution number of the engine between the staring time and the idling time of the engine in such a manner that when the engine is started, the potential difference between voltages at the input terminals of the comparison circuit, the voltages being determined by the bias voltage and the set voltage, assumes a first value which is smaller than the voltage of ignition signal, and when the engine is idling, the potential difference assumes a second value which is smaller than the voltage of ignition signal, but is sufficiently larger than the first value.

In accordance with the present invention, there is provided an ignition device for an internal combustion engine which comprises an ignition signals generating device which generates in synchronism with the revolution of an engine an ignition signal having the magnitude corresponding to a revolution number of the engine, a d.c. bias circuit which superimposes a d.c. bias voltage on the ignition signal, a threshold setting circuit for determining a threshold level voltage, a comparison circuit having the first input terminal for receiving a signal obtained by superimposing the ignition signal and the d.c. bias voltage and the second input terminal for receiving the threshold level voltage to thereby generate an output having an inverse level in response to the magnitude of the input voltages inputted to the input terminals, and a switching circuit for controlling a primary current to an ignition coil in response to the output of the comparison circuit, wherein the threshold level voltage at the time of supplying the primary current to the ignition coil is determined by a circuit having the same construction as the d.c. bias circuit.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
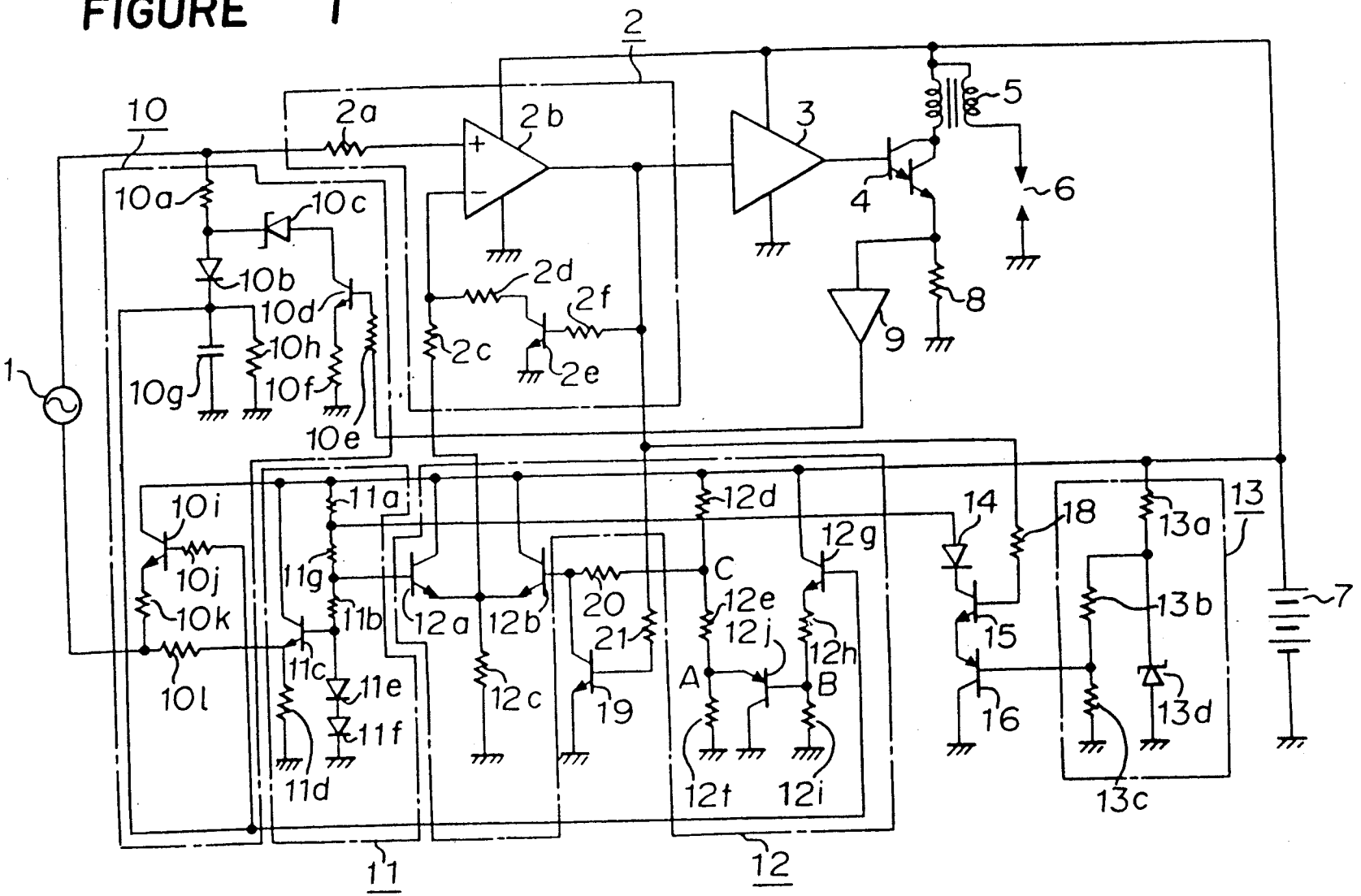
FIG. 1 is a circuit diagram of an embodiment of the ignition device for an internal combustion engine according to the present invention.

Referring to the drawings, wherein the same reference numerals designate the same or corresponding parts, there is shown an example of the ignition device for an internal combustion engine of the present invention. In FIG. 1, numerals 1 through 21 designate the same elements as in FIG. 4 and accordingly, description of these parts is omitted.

The transistor 19 has its emitter grounded and its base connected to the output side of the comparison circuit 2b through the resistor 21, the base of the transistor 19 being also connected to the base of the transistor 2e through the resistor 2f and connected to the base of the transistor 15 through the resistor 18. The collector of the transistor 19 is connected to the base of the transistor 12b. The resistor 20 is connected between the junction C and the base of the transistor 12b.

Figure 4:
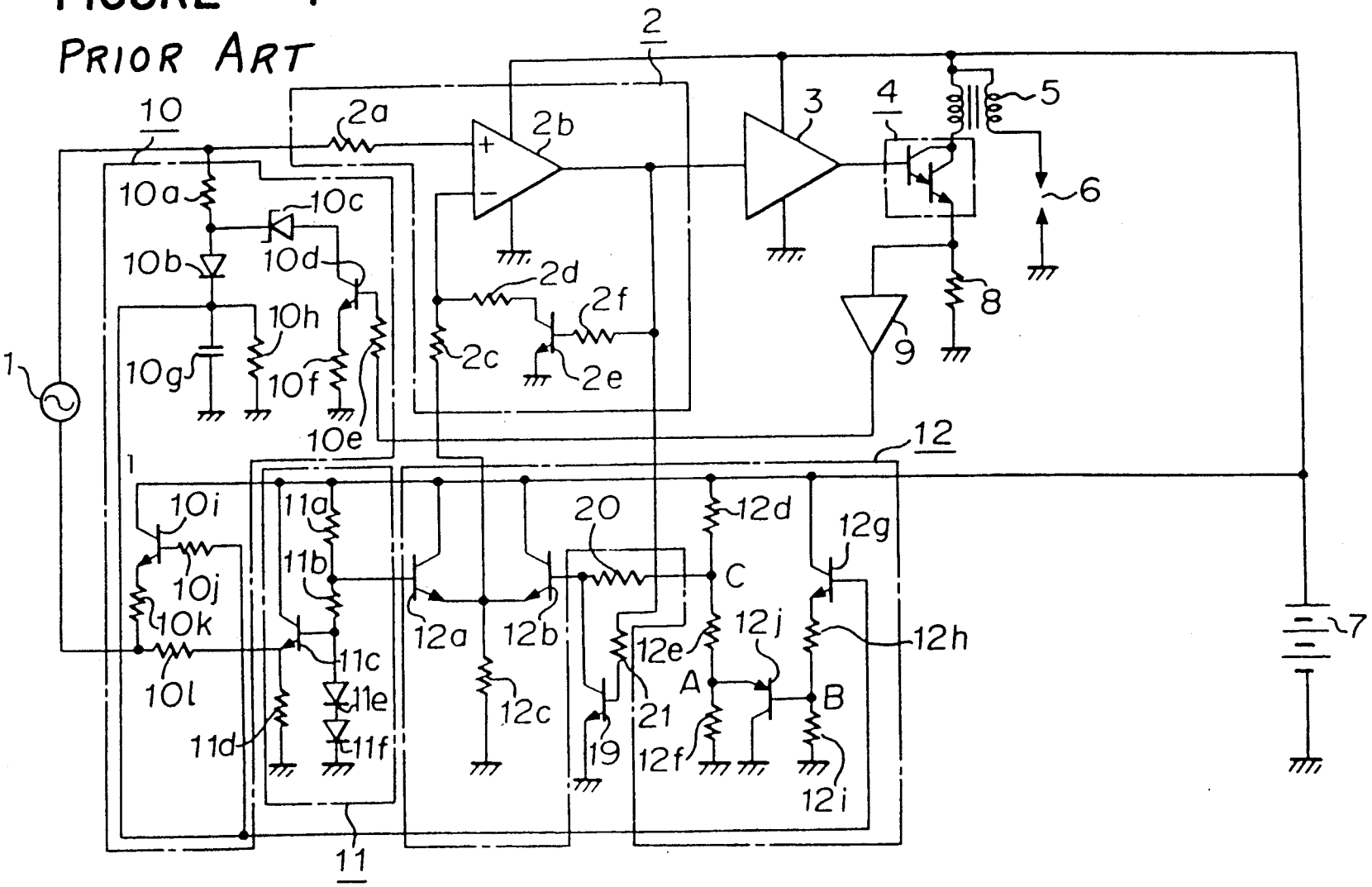
FIGURE 4 PRIOR ART
FIGS. 4 and 5 are respectively circuit diagrams showing conventional ignition devices for an internal combustion engine.

The operation to ignite the engine is the same as that described above. The operation level VON or VOFF of the comparison circuit 2b which is the characteristic features of the present invention will be described. The operation level VON is increased when the bias circuit 10 and the switching operation level circuit 12 as shown in FIG. 4 effectively operate and the revolution number of the engine increases.

When the revolution number of the engine is more than an idling revolution number, the base voltage of the detecting transistor 16 which is given by the resistors 13*b* and 13*c* with the increase of the power source voltage, is increased, whereas the base voltage of the transistor 16 is substantially constant in a voltage region higher than the power source voltage which effects the actuation of the voltage regulator element 13*d*.

On the other hand, the transistor 15 is turned on by the output of the comparison circuit 2*b* when the ignition signal level is higher than the operation level VON. Then, the voltage applied to the comparison circuit 2*b* through the common emitters of the transistors 12*a*, 12*b* is constant. Further, the transistor 2*e* is turned on in a period that the transistor 15 is turned on by the output of the comparison circuit 2*b*, whereby a signal of operation level VOFF having substantially constant operation level is obtained through the resistor 2*d* in a voltage region higher than a predetermined power source voltage. Namely, it is possible to increase histeresis and durability to induction noises without the change of level by the comparison circuit 2*b* in a region higher than a predetermined revolution number of the engine.

In the above-mentioned embodiment of the present invention, an operation level (VOFF) of the comparison circuit is clamped by the transistor circuit when the revolution number of the engine is higher than the idling revolution number. Accordingly, durability to induction noises in a revolution number of engine higher than the idling revolution number can be increased while the starting characteristic of the engine is maintained.

Figure 2:
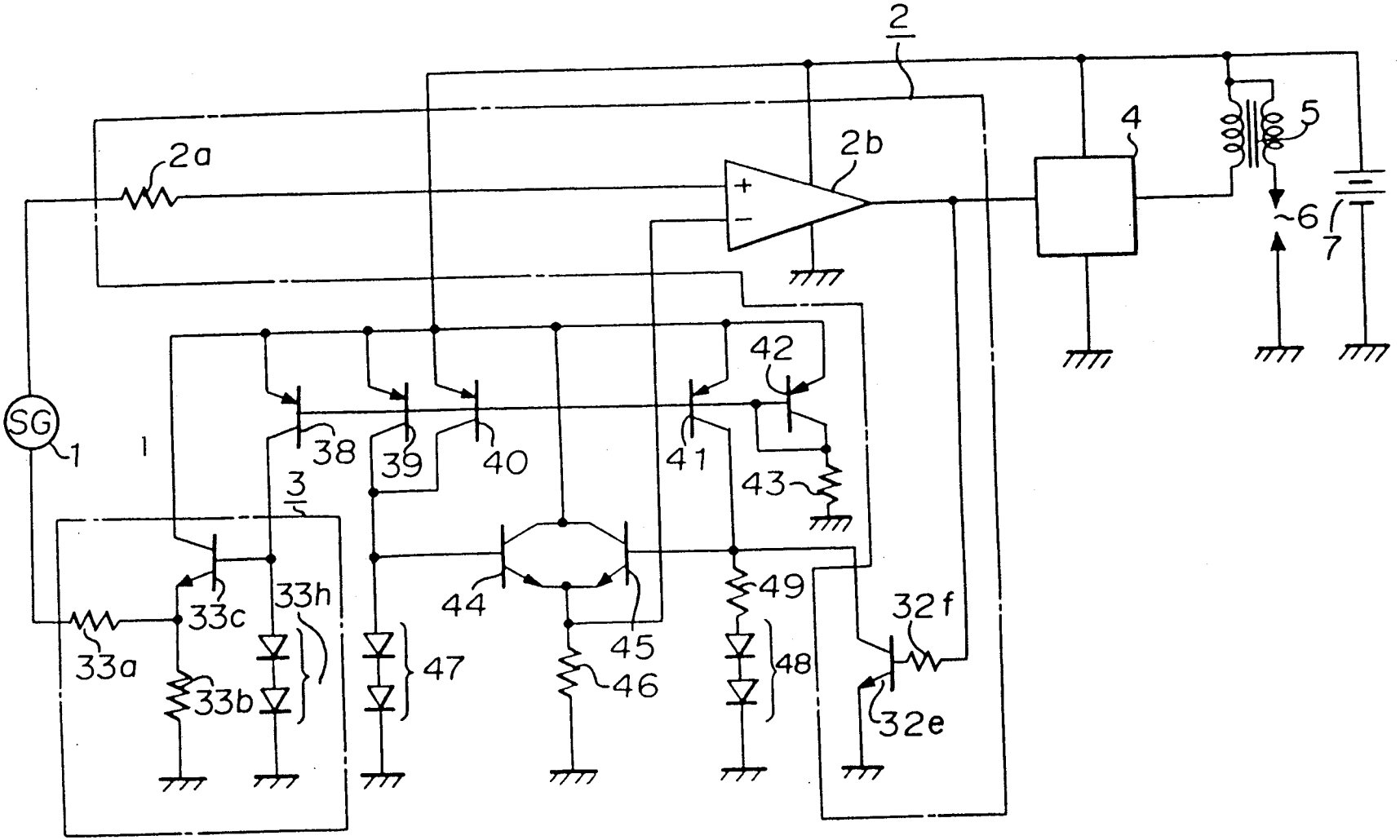
FIG. 2 is a circuit diagram of another embodiment of the ignition device for an internal combustion engine according to the present invention.
Figure 5:
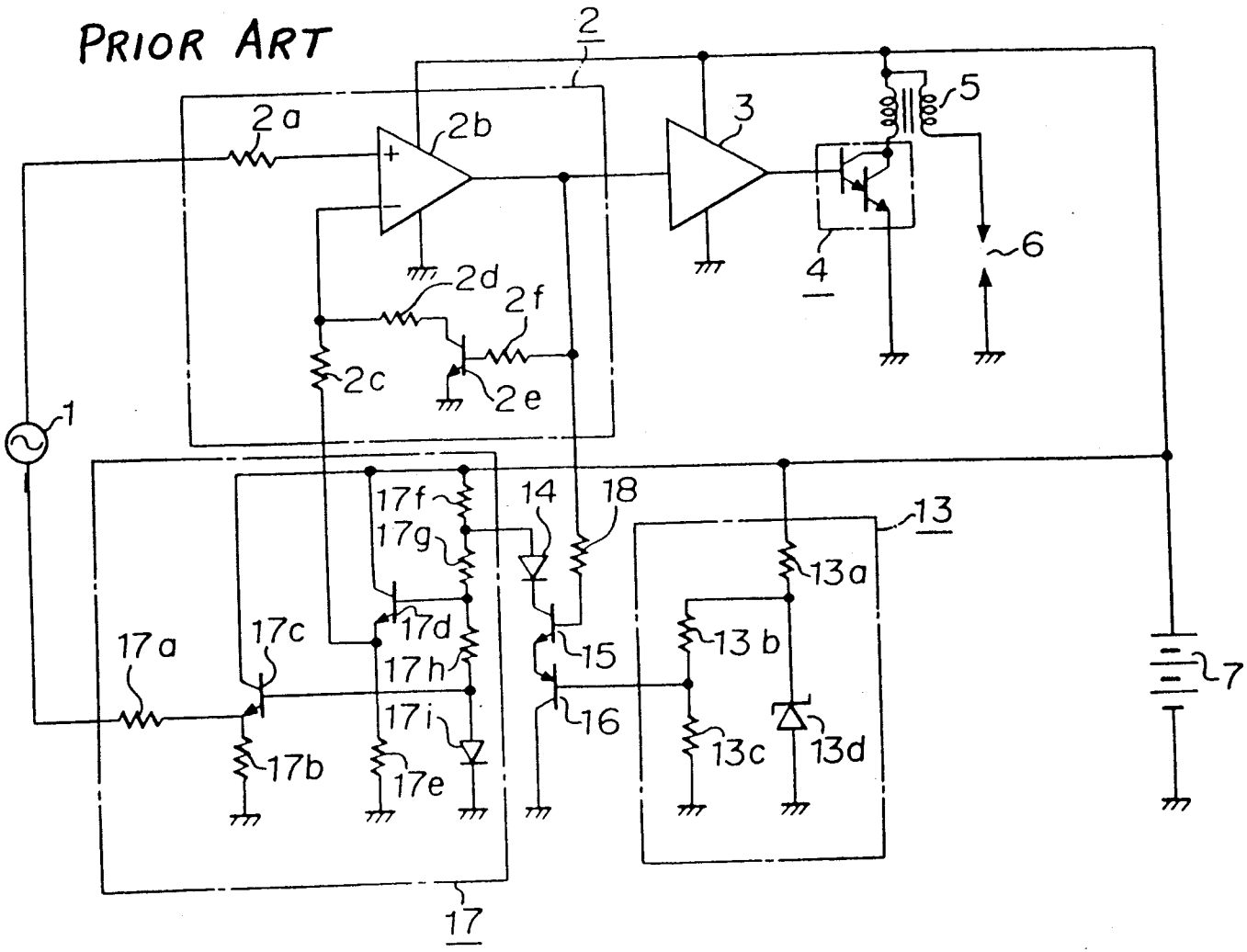
FIGURE 5 PRIOR ART

FIG. 2 is a circuit diagram of another embodiment of the ignition device for an internal combustion engine of the present invention. In FIG. 2, reference numerals 1 through 7 designate the same or corresponding parts as in FIG. 5.

Reference numerals 38, 39, 40, 41 designate respectively transistors which have a common base and emitters commonly connected to the d.c. power source 7. The collector of the transistor 38 is grounded through diodes 33*h*. The collector of the transistor 39 is connected to the collector of the transistor 40, and the junction of the collectors of the transistors 39, 40 is grounded through diodes 47. The collector of the transistor 41 is grounded through a resistor 49 and diodes 48. The base of a transistor 42 is connected to the bases of the transistors 38, 39, 40, 41. The collector of the transistor 42 is grounded through a resistor 43, and the emitter is connected to the d.c. power source 7. A transistor 44 has its base connected to the anode of a serial connection of diodes 47, its collector connected on one hand to the collector of a transistor 45 and on the other hand to the d.c. power source 7, and its emitter connected to the emitter of the transistor 45 through a resistor 46. The base of the transistor 45 is connected to the collector of a transistor 32*e*. The transistors 38, 39, 40, 41 and 42 constitute a current mirror circuit.

Figure 3:
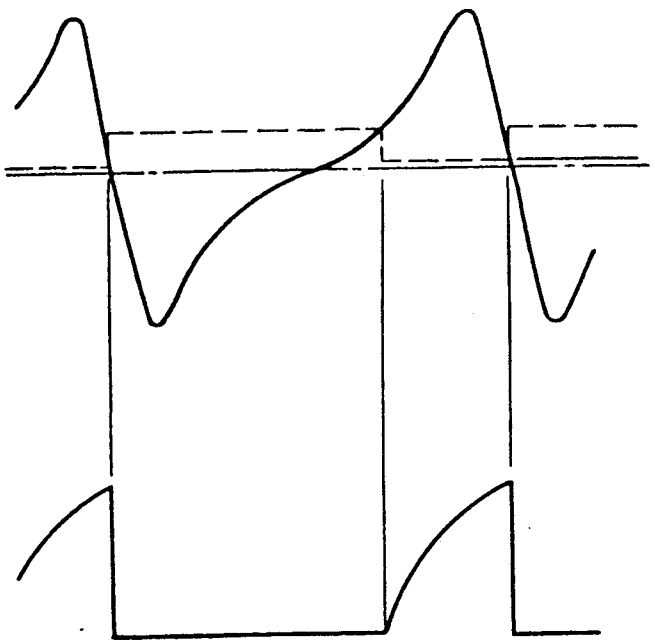
FIG. 3 is a diagram showing the waveform of a signal in the second embodiment of the present invention.

FIG. 3 is a diagram showing a relation of the operation levels of the comparison circuit 2*b* to an ignition signal generated from the ignition signal generating device 1 in the ignition device having the construction as shown in FIG. 2.

Description will be made as to a d.c. bias voltage and operation levels VON, VOFF.

Each collector current $I_1$ flowing through the transistors 38, 39, 40, 41 and 42 which constitute the current mirror circuit is determined by the transistor 42, the resistor 43 and a power source voltage. A d.c. bias voltage $V_{BIAS}$ is determined by the transistor 33*c* on the basis of a forward voltage $V_F(33h)$ of a diode 33*h*, and is expressed by:

$$V_{BIAS} = V_F(33h) - V_{BE}(33c)$$

where $V_{BE}(33c)$ is a forward voltage between the base and emitter of the transistor 33*c*.

The operation level VON is determined by a forward voltage $V_F(48)$ of a diode 48, a voltage produced in a resistor 49 and a transistor 45, and is expressed by:

$$VON = V_F(48) + I_1 \times R(49) - V_{BE}(45)$$

where R(49) is the resistance of the resistor 49 and $V_{BE}(45)$ is a forward voltage between the base and emitter of the transistor 45.

When the engine is actuated and a level in the ignition signal of the ignition signal generating device 1 exceeds a voltage ΔVON which is the difference between the operation level VON and the d.c. bias voltage $V_{BIAS}$, the output of the comparison circuit 2*b* is inversed, and the primary current is passed through an ignition coil 5 to actuate it. At this moment, the difference voltage ΔVON is expressed by the following equation:

$$\begin{aligned} \Delta VON &= VON - V_{BIAS} \\ &= (V_F(48) - V_F(33h) + I_1 \times \\ &\quad R(49) - (V_{BE}(45) - V_{BE}(33c) \end{aligned}$$

In this case, currents flowing in the diodes 33*h*, 48 have same current value $I_1$, and accordingly the emitter current of the transistor 33*c* is substantially equal to the emitter current of the transistor 45 if a resistor 33*b* has the same value as a resistor 46. Accordingly, if the diode 33*h*, the resistor 33*b* and the transistor 33*c* respectively coincide with the diode 48, the resistor 46 and the transistor 45, the following equations are established:

$$V_F(48) = V_F(33h),\ V_{BE}(45) = V_{BE}(33c)$$

Accordingly the difference pressure ΔVON is expressed as follows:

$$\Delta VON = I_1 \times R(49)$$

When the level of the ignition signal exceeds the voltage difference ΔVON and the output of the comparison circuit 2*b* is reversed, the transistor 32*e* is turned on and the transistor 45 is turned off, whereby a forward voltage $V_F(47)$ of a diode 47 is applied to the comparison circuit 2*b* as an operation level signal VOFF through a transistor 44. This is expressed as follows:

$$VOFF = V_F(47) - V_{BE}(44)$$

where $V_{BE}(44)$ is a forward voltage between the base and emitter of the transistor 44.

When the level in waveform of the ignition signal is lower than the difference voltage VOFF between the operation level VOFF and the d.c. bias voltage $V_{BIAS}$, the output of the comparison circuit 2*b* is reversed again, whereby an operation level signal VON is supplied to the comparison circuit 2b, and at the same time, the primary current to the ignition coil 5 is interrupted so that a predetermined ignition voltage is produced at the ignition coil 5. At this moment, the voltage difference ΔVOFF is expressed as follows:

$$\begin{aligned}\Delta VOFF &= VOFF - V_{BIAS} \\ &= (V_F(47) - V_F(33h) - (V_{BE}(44) - V_{BE}(33c)\end{aligned}$$

In the above described equation, the intensity of a current flowing in the diode 47 is twice that of a current in the diode 33h. When the value of the resistor 33b is made equal to the value of the resistor 46, the emitter current of the transistor 33c is substantially equal to that of the transistor 44. Accordingly, if the values of the diode 33h, the resistor 33b and the transistor 33c respectively coincide with the values of the diode 47, the resistor 46 and the transistor 44, the following equations are established.

$$VF(47) - VF(33h) = 2 \times \frac{kT}{q} \ln \frac{2 \times I_1}{I_1},$$

$$V_{BE}(44) = V_{BE}(33c)$$

Accordingly ΔVOFF is expressed as follows:

$$\Delta VOFF = 2 \times \frac{kT}{q} \ln 2 \simeq 35 \text{ [mV]}$$

where k is the Boltzmann constant, T is the absolute temperature and q is the electric charge of an electron.

Accordingly in determining the operation level which determines the timing of interrupting the primary current, it is possible to determine the operation level to a slightly positive voltage side with respect to the d.c. bias voltage for an ignition signal irrespective of the fluctuation of the power source voltage and the scattering of the structural elements. Therefore, stable ignition timing and interrupting function can be obtained.

Obviously, numerous modifications and variations of the present invention are possible in light of the above teachings. It is therefore to be understood that within the scope of the appended claims, the invention may be practiced otherwise than as specifically described herein.

What is claimed is:

1. An ignition device for an internal combustion engine which comprises:

an ignition signal generating device which generates in synchronism with the revolution of an engine an ignition signal having the magnitude corresponding to a revolution number of the engine, a bias circuit which generates a bias voltage corresponding to the revolution number of the engine so as to superimpose the bias voltage on the ignition signal so that the closing rate of the primary power feeding circuit for an ignition coil is controlled, a switching operation level setting circuit for generating a set voltage which changes depending on the revolution number of the engine at the time of the starting of the engine or at the idling operation, a comparison circuit having a first input terminal adapted to receive a superimposed output of the ignition signal and the bias voltage and a second input terminal adapted to receive the set voltage wherein the comparison circuit generates an output inversed in level in response to the magnitude of input signals at the first and second input terminals, a transistor to feed or break a current to be fed to the ignition coil by an output from the comparison circuit, a histeresis setting circuit to impart histeresis to the switching operation of the comparison circuit by changing the set voltage inputted to the second input terminal in synchronism with the turning-on of the transistor, a reference voltage generating circuit which fixes the potential of a plurality of resistors in the bias circuit when a power source voltage exceeds a predetermined value, and a transistor circuit which controls current conduction to the plurality of resistors and the reference voltage generating circuit in response to the operation of the comparison circuit, wherein the magnitude of said set voltage is changed in response to a value of revolution number of the engine between the staring time and the idling time of the engine in such a manner that when the engine is started, the potential difference between voltages at the input terminals of the comparison circuit, the voltages being determined by the bias voltage and the set voltage, assumes a first value which is smaller than the voltage of ignition signal, and when the engine is idling, the potential difference assumes a second value which is smaller than the voltage of ignition signal, but is sufficiently larger than the first value.

* * * * *